United States Patent [19]

Kuang-Wen

[11] Patent Number: 4,930,926

[45] Date of Patent: Jun. 5, 1990

[54] BINDER FOR REMOVABLE LEAVES

[76] Inventor: Roan Kuang-Wen, 3F., No. 59, Ta Chu Street, Taipei, Taiwan

[21] Appl. No.: 221,754

[22] Filed: Jul. 20, 1988

[51] Int. Cl.[5] ..... B42F 13/18

[52] U.S. Cl. ..... 402/55; 402/80 P; 281/17

[58] Field of Search ..... 281/15.1, 17, 21.1; 402/22, 26, 31, 29, 42, 46, 47, 55, 56, 80 R, 80 P

[56] References Cited

U.S. PATENT DOCUMENTS 3,768,838 10/1973 Shibata ..... 402/80 P
4,601,489 7/1986 Stancato ..... 281/17 X
4,743,134 5/1988 Reinherz et al. ..... 402/55 X

FOREIGN PATENT DOCUMENTS 22569 7/1921 France ..... 402/55

*Primary Examiner*—Paul A. Bell
*Attorney, Agent, or Firm*—Balogh, Osann, Kramer, Dvorak, Genova & Traub

[57] ABSTRACT

A binder for attaching separate leaves together in a non-permanent fashion. The binder comprises a scarfing section, a clamping section, and tenons. Each binder is attachable to additional binders such that the number of leaves held together by the device is adjustable, and is virtually unlimited.

4 Claims, 4 Drawing Sheets

BINDER FOR REMOVABLE LEAVES

BRIEF SUMMARY OF THE INVENTION

This invention is to provide a removable leaves binder which is specially designed for the binding of albums or files to enable the number of inner leaves to be increased or decreased without limit.

An album or file is one of the most commonly used stationery. The modes of binding the inner leaves may be catagorized into the fixed type or unfixed type.

The inner leaves of the fixed type are directly bound together by a binding machine at the time when the binder is initially made. In the albums or files of this type, the inner leaves cannot be increased, decreased, or disassembled. Due to the limitation of the number of leaves, end-users must periodically obtain completely new albums to satisfy their requirements. The costs for new albums is excessively high.

The unfixed type, referred to here as the removable type, has a fixed spaced which is formed by the two claws of a movable clamping device inside the space of its covers which allows the number of inner leaves to be increased or decreased at will by the end-users. A file or ring binder is an example of this type. Although the leaves can be either inserted or taken away through the opening formed by releasing the two claws of the movable clamping device, the high fabrication cost of the movable clamping device and the limited space formed by its two claws are flaws which mar perfection. In addition, the leaves which are piled up on top of the leaf which is to be taken out must first be removed. This is regarded as another defect.

In view of these defects, the inventor, having accumulated years of practical experience in the fabrication of albums, decided to devote himself to developing an improvement. He developed a non-movable type of connecting piece, which is not only as strongly built as the fixed type of binding, but also allows increasing or decreasing the inner leaves of an album at will, as with an unfixed type of album or file. The defect of having a limited binding space, as with the previous unfixed types, is eliminated. Moreover, this new device is simpler in its fabrication technique and lower in cost than that of the conventional types of albums of files.

Therefore, the main object of this invention is to provide a strongly built and simply constructed binder, by means of which the inner leaves of an album or file can be increased, decreased, or disassembled at will, without limitation as to the number of leaves contained thereby.

Another object of this invention is to provide a device which can be formed into an integral body with the inner leaves of an album or file.

Still another object of this invention is to allow endusers to directly take off the particular leaf desired from among the leaves which are piled up, thereby providing a detachable leaf connecting piece for an album or a file.

A still further object of this invention is to provide a plastic, mass produced, and integrally formed connecting piece for an album or a file, which has a low cost, and which facilitates the detachment and binding functions.

BRIEF DESCRIPTION OF THE DRAWINGS

Other features and objects of the present invention can be readily understood from the following detailed description, disclosure, and drawings. Drawing numerals refer to parts as indicated in the several diagrammatic views described below.

DETAILED DESCRIPTION OF THE INVENTION

Figure 1:
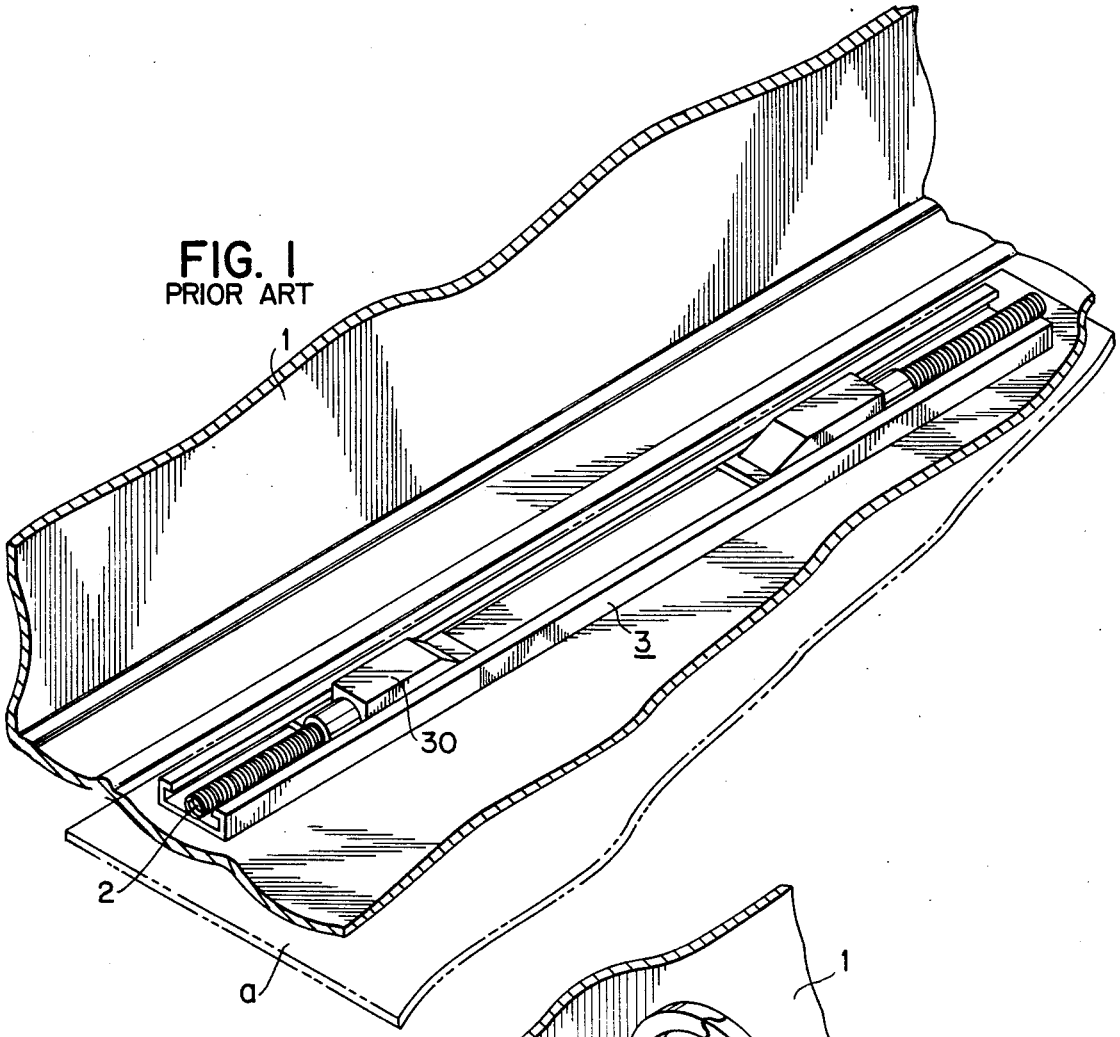
FIG. 1 PRIOR ART
FIG. 1 is a perspective view of the current clamping device for albums or files.

FIG. 1 indicates a conventional file clamping device, wherein a thick cardboard or a plastic board is used to form a cover 1. The top and the end cover are tightly joined together, being fixed inside with two bendable annular-shaped metallic strips which interact with a fixed iron strip or sheet 2, and also having two fixing devices 3, in the form of sliding pushing blocks 30. The papers or leaves inside the file, after having been punched by a puncher, can be sleeved onto the metallic strip or iron strip. Then, by means of the sliding function of the two pushing blocks 30, the two bending strips 2 may be bent, so as to bind the papers or inner leaves (a) of a file or album. By setting the fixing device 3 and the metallic strip 3 apart, the end-users will be able to assemble or disassemble the file in order to increase or decrease the number of the inner leaves. As is known, when the inner leaves have been piled up close to the height of the metallic strip of a file, the normal function of the fixing device 3 will not be satisfactorily performed. Under these conditions, the fixing device 3 may loose its grip over the inner leaves, such that the inner leaves or papers will separate from the cover 1.

Figure 2:
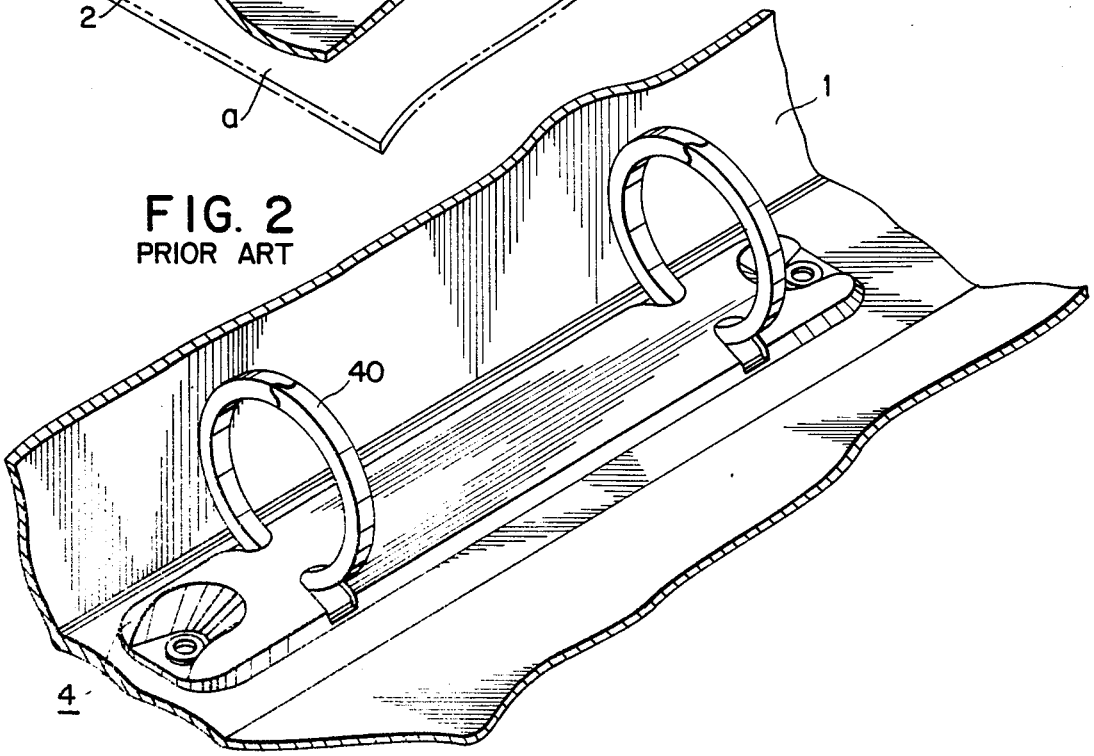
FIG. 2 PRIOR ART
FIG. 2 is a perspective view of a conventional file clip.

Another type of binder comprises a file which has an annular-shaped file clip, with a space formed by two symmetrical hooking claws as a means of clamping its inner leaves. FIG. 2 discloses such a binder, wherein a thick cardboard or plastic board is used as a cover 1, and the top and bottom covers are tightly fixed together. A clamping device 4 is set at the joining position of the top and the bottom covers, on which two annular-shaped, symmetrical hooking claws 40 are also set. The limited space which is formed allows an increase or decrease in the number of inner leaves, by tightening or releasing the clamping device as required. However, if certain inner leaves of an album have to be taken off when they have been fully piled up, all the inner leaves of the file which are piled up on top of the particular leaves must be removed from the file to allow removal of the desired leaves. Also, the restoration of such inner leaves which have previously been taken away will have to be conducted with great care to avoid confusing the proper order of arrangement.

Figure 3:
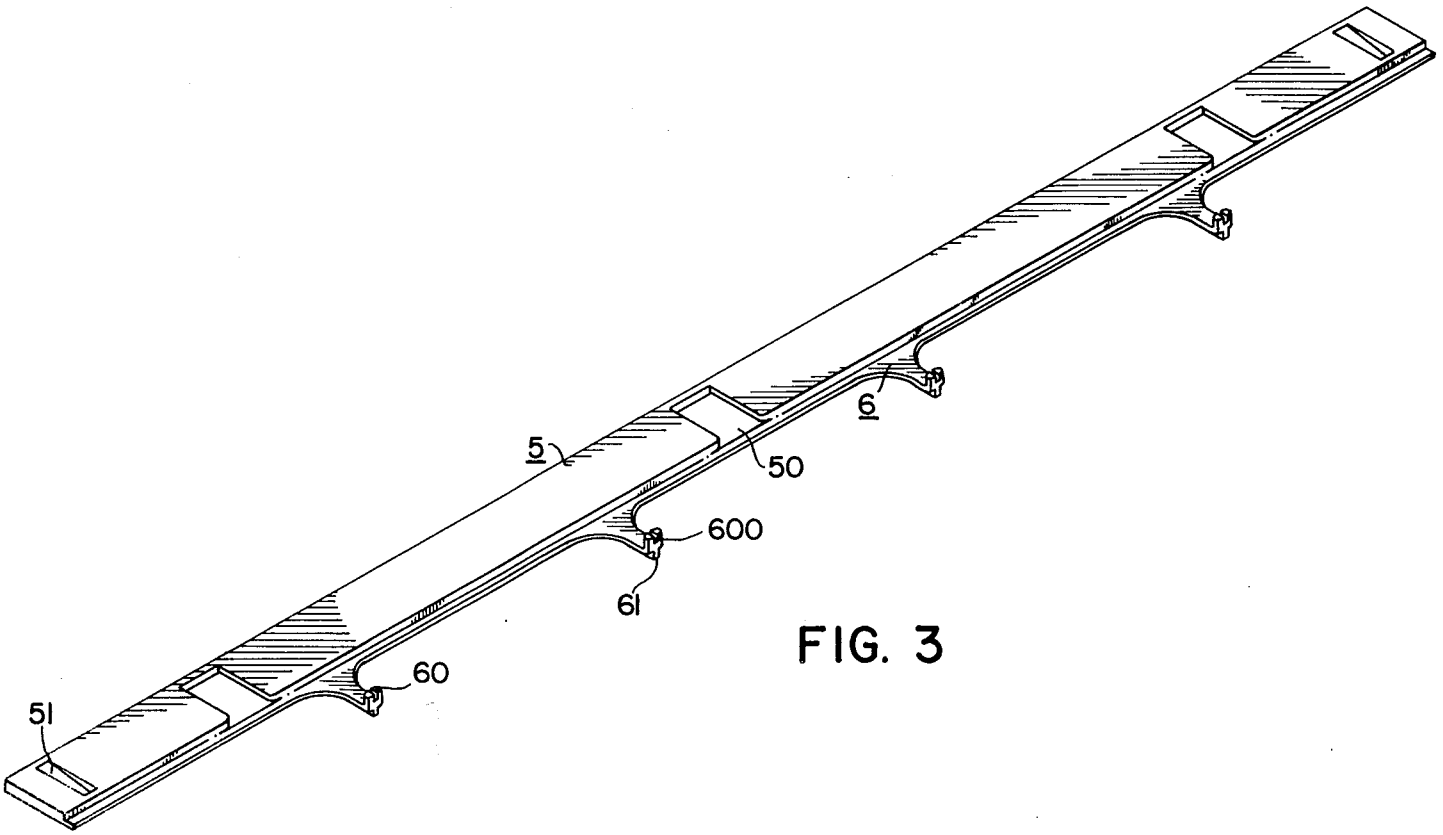
FIG. 3 is a perspective view of the present invention.
Figure 4:
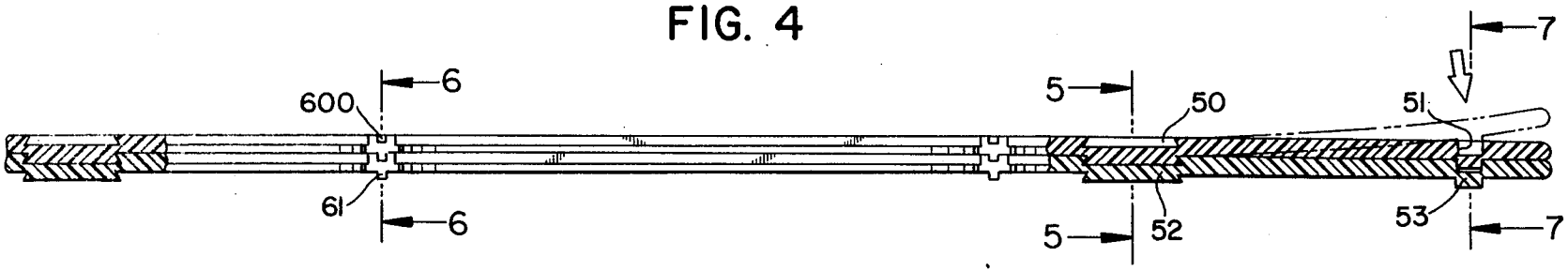
FIG. 4 is a front view of the interconnection of two elements of this invention.
Figure 6:
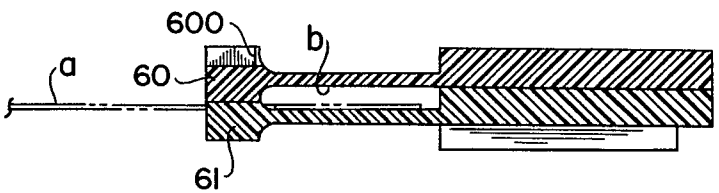
FIG. 6 is a side view of the embodiment of the mode of clipping the inner leaves of albums, files or similar articles as provided by this invention.
Figure 5:
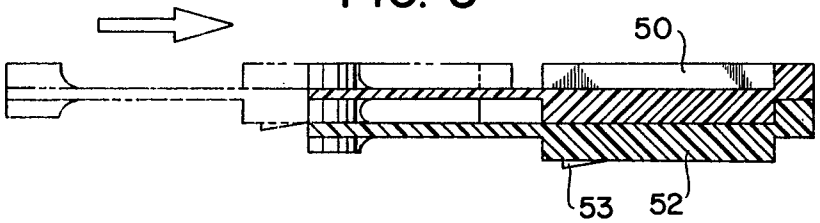
FIG. 5 is a side view of the connection of the dovetail sliding groove with the dovetail sliding block.
Figure 7:
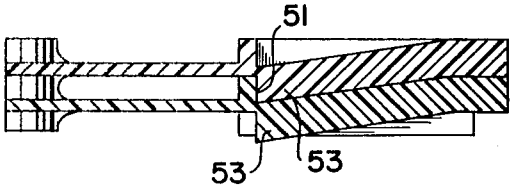
FIG. 7 is a side view of the interconnection of the sandwiching with the sandwiching block.

The present invention will not only eliminate the defects of the prior art, and relieve the end-users from the inconvenience of assembling and disassembling a file, but will also further provide an easily operated device which can tightly fix and bind an unlimited number of leaves of a file or album. As shown in FIG. 3, there is an integrally formed plastic strip, on which a scarfing section 5 and a clamping section 6 are disposed, which has, on the obverse side of section 5, a dovetail sliding groove 50 having a slantingly-shaped sandwiching groove 51 on both its obverse and reverse sides. A dovetail sliding block 52 and a convexed slantingly-shaped sandwiching block 53 are disposed on the reverse side. The clamping section 6 is approximately ⅓ in thickness as compared to the scarfing section. On the obverse side are convexed tenons which match the binding holes for the inner leaves of an album. The convexed tenons are semi-circular in shape, and have a groove 600. A convexed block 61 similar in dimension to that of the various convexed tenons 60 is set at the reverse side of the clamping section 6. By placing the obverse side of a sheet against the reverse side of another sheet and thus having them connected sheet by sheet, an unlimited number of the inner leaves of an album may be bound together. An example describing the mode of connecting two sheets together is detailed as follows:

As shown in FIG. 5, the two inserting/connecting strips are inter-scarfed together by means of inserting the dovetail sliding block 52 into the dovetail sliding groove 50. The convex block 61 on the clamping section 6 will join together with the groove 600 on the convex tenon 60 to form a tall column (b), approximately ⅓ in thickness to that of the scarfing section. Along this tall column (b), the inner leaves (a) of a file or album can be inserted and clamped as shown in FIG. 4 and FIG. 6. Then, by exerting a pressure onto the two sides of the strip, the convexed slantingly-shaped sandwiching block 53 and the slantingly-shaped sandwiching groove 51 are engaged as is shown in FIG. 4 and FIG. 7. This will press the two pieces tightly together, while in the clamping section 6, a space formed by a tall column will contain the inner leaves (a). The inner leaves of a file or an album will then be clamped by the clamping section 6 to achieve the object of an unlimited binding volume. When the inner leaves must be removed, the end-user may remove the leaves by reversing the above-mentioned steps. First, the sandwiching block 53 and the sandwiching groove 51 are taken away from the two sides of the document strip. Then, the dovetail sliding groove 50 and the dovetail sliding block 52 are pushed in a direction opposite to that of the former scarfing direction (the reversed direction as indicated by the arrow in FIG. 5). The papers or inner leaves which are desired to be removed from a file or album can then be taken off from the clamping section. From the above-mentioned description, it can be seen that this invention may be used not only to bind an unlimited number of inner leaves (a) of a file or album, but it also allows the desired documents or papers to be rapidly removed by disassembling the inserting/connecting strips.

Figure 8:
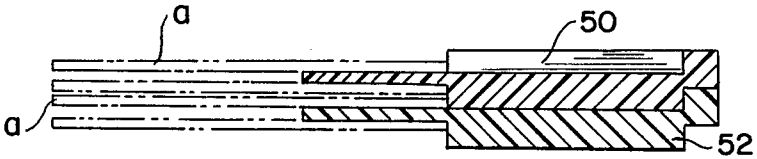
FIG. 8 is a side view of another embodiment of the invention whereby clipping the album, files, or similar articles is accomplished.

FIG. 8 illustrates an alternative clamping means provided by this invention, wherein no convexed tenon 60 or convexed block 6 structure are utilized. Instead, a plain, straight shape is disclosed. The plastic inner leaves (a) of an album are adhered onto the plane of the clamping section 6 by means of high frequency hot pressing method, thereby forming an integral body. Alternatively, the plastic inner leaves (a) may be placed in the die, adhering them together into an integral body during the course of its forming process. The end-user will not have to go through a preliminary process of having the inner leaves (a) punched by a puncher before binding. All that is necessary is to make use of the sheet by sheet scarfing of the scarfing section 5, thereby causing the inner leaves (a) of an album or the papers of a file to be bound.

Figure 9:
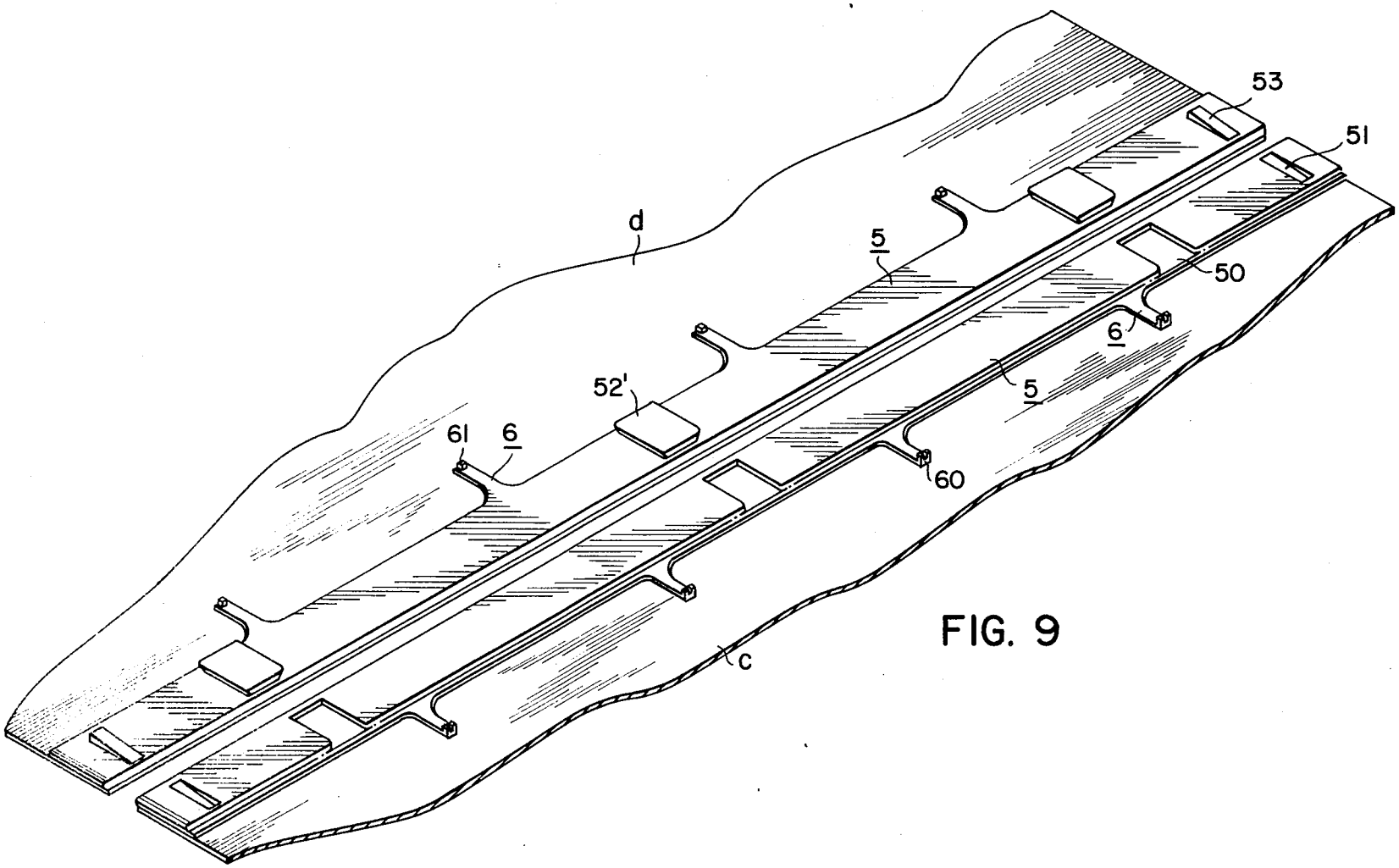
FIG. 9 is a perspective view illustrating the top and the end sheets adhered to the inside leaves of the covers of this invention.

The front and the back sheet bodies are slightly different in structure from the forementioned sheet body, being made from flat plastic which is tightly fixed onto the edges of the front and the back page. The two sheet-bodies are made such that the obverse side of one sheet and the reverse side of another sheet are pressed against one another. A dovetail sliding groove 50 and a slantingly-shaped sandwiching groove 51 are glued onto the upper sheet body scarfing section of the front page (c), and a semicircular convexed tenon 60 is glued onto the clamping section 6. A dovetail sliding block 600 and a convexed slantingly-shaped sandwiching block 53 are tightly glued onto the upper sheet-body scarfing section of the last page of the cover. A convexed block 61 is housed into the groove 600 of the convexed tenon 60, as indicated in FIG. 9. Therefore, in addition to utilizing the inter-scarfing of the various sheet-bodies to enable the inner leaves (A) to be bound virtually without limit, both the front and the last page can be used as a middle sheet-body of the cover, so as to cut down the cost by reducing paper consumption.

Summarizing the above description, it can be seen that this invention provides an easily operated binder which can allow the inner leaves of a file or an album to be increased and decreased as needed. Also, the inner leaves of a file or album may be directly and rapidly disassembled and removed from the file or album.

I claim:

1. A strip-shaped binder comprising a scarfing section having an obverse side and a reverse side, said obverse side of said scarfing section having one or more dovetail sliding grooves and one or more slantingly-shaped sandwiching grooves, one or more dovetail sliding blocks disposed on said reverse side of said scarfing section directly opposite said dovetail sliding grooves, one or more slantingly-shaped sandwiching blocks disposed on said reverse side of said scarfing section directly opposite said slantingly-shaped sandwiching grooves, one or more clamping sections protruding from said scarfing section, each of said clamping sections having a groove disposed on one side, convex tenons and a convex block disposed, on a side opposite said groove, on each of said clamping sections, said dovetail sliding blocks and said slantingly-shaped sandwiching blocks being engageable with corresponding dovetail sliding grooves and slantingly-shaped sandwiching grooves of an adjacent binder, such that adjacent binders may be attached together, said convex blocks being engageable with said groove and said convex tenons such that leaves having punched holes may be held in place by the connection of said convex blocks with said groove and said convex tenons.

2. A binder in accordance with claim 1, wherein the number of said clamping sections corresponds with the number of punched holes in leaves to be bound in said binder.

3. A binder in accordance with claim 1, wherein said clamping sections have a flat surface disposed on each side of said clamping sections, such that leaves are directly adhered to said flat surfaces.

4. A binder in accordance with claim 1, wherein an obverse side of a top binder and a reverse side of a bottom binder are shaped to define a flat surface, such that a top cover may be adhesively attached to said flat surface of said obverse side of said top binder, and a bottom cover may be adhesively attached to said flat surface of said reverse side of said bottom binder.

* * * * *